US006718238B1

(12) United States Patent
Laguer-Diaz et al.

(10) Patent No.: US 6,718,238 B1
(45) Date of Patent: Apr. 6, 2004

(54) CALL RECOVERY PROCESS AND APPARATUS FOR A REMOTE MONITORING SYSTEM

(75) Inventors: Juan Laguer-Diaz, San Juan, PR (US); Carl Frederick Conrath, Erie, PA (US)

(73) Assignee: General Electric Company, Schenectady, NY (US)

( * ) Notice: Subject to any disclaimer, the term of this patent is extended or adjusted under 35 U.S.C. 154(b) by 609 days.

(21) Appl. No.: 09/697,250

(22) Filed: Oct. 26, 2000

Related U.S. Application Data

(60) Provisional application No. 60/162,294, filed on Oct. 28, 1999.

(51) Int. Cl.[7] ..... G01M 17/00

(52) U.S. Cl. ..... 701/33; 701/36

(58) Field of Search ..... 701/33, 36; 340/5.28, 340/5.5, 825.69, 825.72

(56) References Cited

U.S. PATENT DOCUMENTS 5,479,157 A * 12/1995 Suman et al. ..... 340/5.28

* cited by examiner

*Primary Examiner*—Yonel Beaulieu
(74) *Attorney, Agent, or Firm*—Carl A. Rowold; John L. DeAngelis, Jr.; Beusse Brownlee Wolter Mora & Maire, P.A.

(57) ABSTRACT

An apparatus and method for re-synchronizing a communications link between an on-board monitor located aboard a vehicle and a remote site. The occurrence of certain events may render the establishment of a communication link between the on-board monitor and the remote monitoring and diagnostics center impossible. To avoid this problem, after a successful download of information to the remote site, the on-board monitor starts a timer. When the timer expires, and if the on-board monitor has not received a call or successfully downloaded information to the remote site since the timer was started, the on-board monitor attempts to call the remote site for providing certain re-synchronization information thereto. The remote site thereafter uses this re-synchronization information to establish communications with the on-board monitor.

19 Claims, 2 Drawing Sheets

CALL RECOVERY PROCESS AND APPARATUS FOR A REMOTE MONITORING SYSTEM

This patent application claims priority based on the U.S. Provisional patent application filed on Oct. 28, 1999 and assigned application Ser. No. 60/162,294.

BACKGROUND OF THE INVENTION

The present invention is directed in general to monitoring operational parameters and fault-related information of a vehicle, and more specifically, to a method and apparatus for recovering from the loss of communications between an on-board monitoring apparatus on the vehicle and a remote site, such as a remote monitoring and diagnostics center.

Cost efficient operation of vehicle fleets requires minimization of vehicle down time, and especially the avoidance of vehicle failures while in service. Failure of a major vehicle system can cause serious damage, require costly repairs, and introduce significant operational delays into the fleet. An in-service failure is an especially costly event as it requires dispatching a replacement vehicle. Further, if the vehicle is a railroad locomotive, a track segment may be rendered unusable until the disabled train is moved. The health of the vehicle and its constituent sub-assemblies is therefore of significant concern to the fleet operator.

One apparatus for minimizing vehicle down time measures performance and fault-related operational parameters of the vehicle during operation. This information can provide timely and important indications of potential failures and valuable diagnostics information for actual faults. With timely and nearly continuous access to vehicle performance data, it is possible for repair experts to predict and/or prevent untimely failures.

One such apparatus, a vehicle on-board monitor, collects and aggregates vehicle operational performance and fault related data and transmits it to a remote site, including a remote monitoring and diagnostics center. The vehicular data is collected periodically by the on-board monitor, or in response to predetermined triggering events that occur within the vehicle during operation. Usually, anomalous or fault data is brought to the attention of the vehicle operator, but the vehicle itself lacks the necessary hardware and software elements to diagnose the fault or offer repair recommendations. It is therefore advantageous to utilize the on-board monitor to collect and aggregate the information and at the appropriate time send it to the remote monitoring and diagnostics service center, where data analysis tools operate on the data to identify the root cause of potential or actual faults. Vehicle operation and maintenance experts also analyze the received data to develop repair recommendations for preventative maintenance or to correct faults. Historical patterns of anomalous data can be important clues to an accurate diagnosis and repair recommendation. Finally, the lessons learned from failure modes in a single vehicle can also be applied to similar fleet vehicles so that the necessary preventive maintenance can be performed before a line-of-service breakdown occurs. If the data analysis process identifies incipient problems, certain performance aspects of the vehicle can be derated to avoid further system degradation and limit violations of operational thresholds until the vehicle can undergo repair at a repair facility.

BRIEF SUMMARY OF THE INVENTION

An on-board monitor aboard a vehicle monitors and collects data indicative of the vehicle operation from several vehicular control systems. This data is stored within the on-board monitor and downloaded to a remote monitoring and diagnostics center for analysis and the generation of repair recommendations. Typically, the downloads occur on a periodic basis, but certain fault events or anomalous conditions on the vehicle will trigger an immediate download, referred to as a call-home event.

A temporary loss of communications between the on-board monitor and the receiving site, typically a remote monitoring and diagnostics center, can occur when the geographical location of the vehicle does not permit a communications path to be established between the vehicle and the remote site (i.e., the communications link is lost or disrupted) or when the vehicle is undergoing repair. Also, installation of new communications hardware on the vehicle requires the execution of a communications system commissioning process, prior to which the vehicle may be unable to connect to the remote site. Therefore the vehicle cannot download the periodic data files nor contact the remote monitoring and diagnostics center if a "call-home" event occurs.

In order to overcome these disadvantages, the present invention sets forth a sequence of events during which the on-board monitor will try to communicate with the remote site. The on-board monitor utilizes call timers and call logs for determining when to initiate calls back to the remote site based on whether previous calls (as logged in the call logs) were successful or unsuccessful.

BRIEF DESCRIPTION OF THE DRAWINGS

The present invention can be more easily understood and the further advantages and uses thereof more readily apparent, when considered in view of the description of the preferred embodiments and the following figures, in which.

DETAILED DESCRIPTION OF THE PREFERRED EMBODIMENTS

Figure 1:
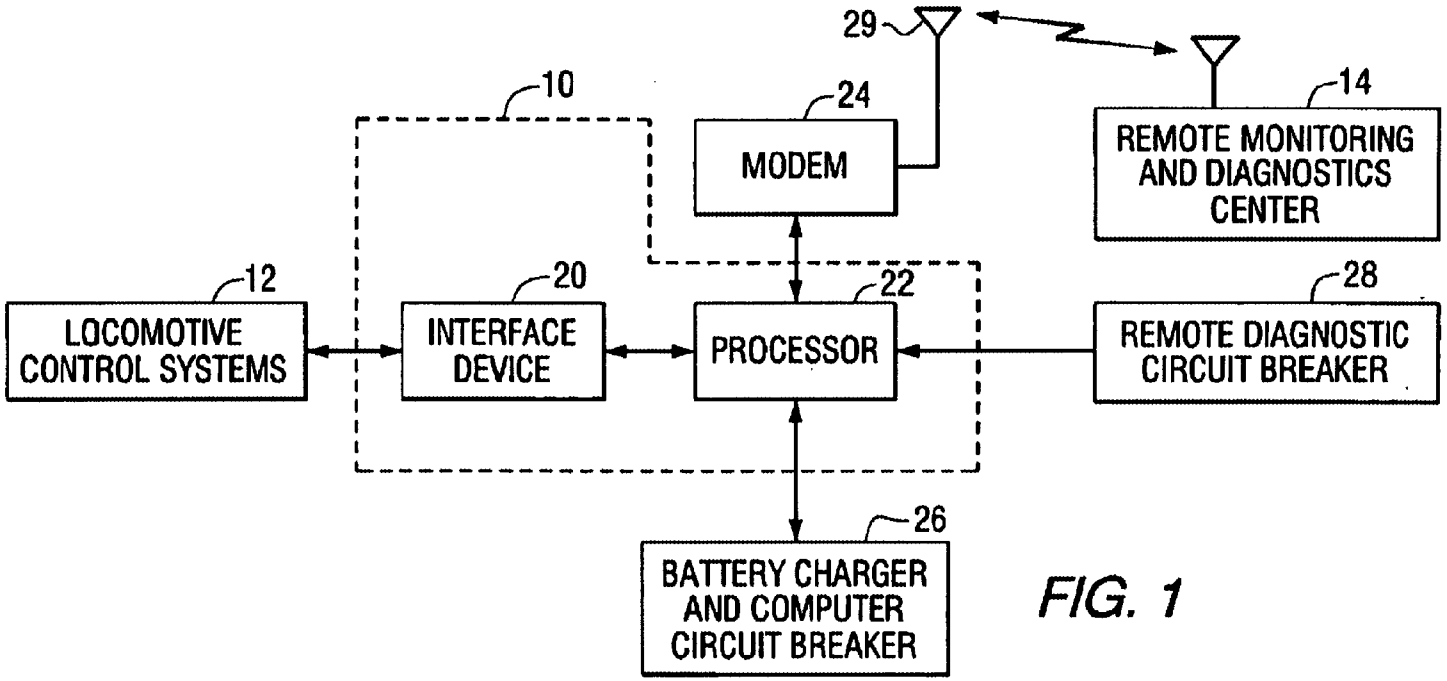
FIG. 1 is a block diagram of the elements of an on-board monitor that is configured according to the teachings of the present invention.

Before describing in detail the particular configuration apparatus and method in accordance with the present invention, it should be observed that the present invention resides primarily in a novel combination of processing steps and hardware related to a software configuration technique. Accordingly, these processing steps and hardware components have been represented by conventional processes and elements in the drawings, showing only those specific details that are pertinent to the present invention so as not to obscure the disclosure with structural details that will be readily apparent to those skilled in the art having the benefit of the description herein.

FIG. 1 is a block diagram of a locomotive-based on-board monitor to which the details of the present invention can be applied. A locomotive on-board monitor 10 is coupled to a plurality of locomotive control systems, depicted generally by a reference character 12. These locomotive control systems can include: a locomotive controller, an excitation controller, an auxiliary equipment controller, and a propulsion system controller. The specific nature and function of the controllers, which are known in the prior art, are not germane to the present invention, except to the extent that the on-board monitor 10 monitors operational parameters associated with these control systems. The data collected by the on-board monitor 10 provides important locomotive performance and status information, which is analyzed at a remote monitoring and diagnostics center 14 to identify active faults, predict incipient failures, and provide timely information about existing operating conditions. If a failure occurs, the data gathering process of the on-board monitor can be modified (either automatically by the system itself or upon command from the remote monitoring and diagnostics center 14) to further isolate or define the nature of the fault. Such modifications can include, for example the collection of different operational information or a change in the frequency of data collection. More generally, the remote monitoring and diagnostic center 14 comprises a remote site with which the on-board monitor 10 communicates for the exchange of information there between.

The on-board monitor 10 performs the functions of a data acquisition, data processing, and logging instrument that provides status information to the remote monitoring and diagnostics center 14 via a bi-directional communication path. Certain parametric and fault-related information gathered by the on-board monitor 10 is collected and stored as raw data in raw data files. Other collected data is used to generate operational statistics, which are also stored. Both the raw data files and the statistical data files are periodically downloaded to the remote monitoring and diagnostics center 14. Likewise, operational and reconfiguration commands are uploaded to the on-board monitor 10 from the remote monitoring and diagnostics center 14.

At the remote monitoring and diagnostics service center 14, the data is analyzed by software based analysis tools and vehicle repair experts to identify root causes and generate repair recommendations.

Specifically, the on-board monitor 10 comprises an interface device 20 and a processor 22. A modem 24 connects directly to the processor 22. In other embodiments, a radio frequency receiver and transmitter or a transceiver may be used in place of the modem 14. The selection of a specific communications device, as known by those skilled in the art is dependent on the type of communications system employed between the vehicle and the remote monitoring and diagnostics center 14. The interface device 20 communicates bi-directionally with the various vehicle control systems 12 and the processor 22. The interface device 20 performs typical data acquisition functions, as is well known to those skilled in the art. The processor 22 controls operation of the on-board monitor 10 including especially control over the nature and frequency at which data is collected from the vehicle control systems 12. The modem 24, under control of the processor 22, communicates with a transceiver at the remote monitoring and diagnostics center 14 via an antenna 29.

Each time the processor 22 powers on or cycles the modem 24, certain tests are performed to check the health of the communications system. Certain other communications system tests are performed on a periodic basis, and the processor 22 continuously monitors the modem 24 for unsolicited messages from its built-in diagnostic test routines. As is known to those skilled in the art, there are a number of appropriate communication schemes for implementing the link between the on-board monitor 10 and the remote monitoring and diagnostics center 14. Included among these schemes are: cellular telephone, satellite phone, or point-to-point microwave. Since the vehicle spends considerable time in transit hauling either freight or passengers, sometimes in remote regions, it has been observed that a satellite-based link provides the most reliable communications medium between the vehicle and the remote monitoring and diagnostics center 14.

The on-board monitor 10 includes a call-home feature where a call to the remote monitoring and diagnostics center 14 is automatically initiated upon the occurrence of certain events on board the locomotive. Execution of the call-home feature is controlled and configured (via a configuration file uploaded from the remote monitoring and diagnostics center 14) such that the call home is made on a pre-established time schedule and/or in conjunction with certain anomalous or fault situations that occur either within the on-board monitor 10 or within one or more of the locomotive control systems 12. For instance, when the on-board monitor 10 detects the occurrence of certain predetermined faults in the vehicle, a call-home is made immediately. Note that for all-but the most serious faults or those that disable it, the vehicle remains in service during the fault condition.

During the call-home, the on-board monitor 10 transfers the contents of a call-home file to the remote monitoring and diagnostics center 14. The file contents include identification of the fault or anomaly that generated the call-home (i.e., the event type), the railroad customer, the locomotive road number, the date and time of the call home, and in some situations an event sub-identification number. The call-home is deemed a success when the on-board monitor 10 has transferred the entire contents of the call-home file to the remote monitoring and diagnostics center 14. In another embodiment of the present invention, rather than placing the call-home information into the contents of the call-home file, the information is included in the file name. That is, the call-home file name is transmitted, but there is no data within the file. The transmitted file is an empty or null file. After receiving the call-home file, the remote monitoring and diagnostics center 14 calls the on-board monitor for receiving additional information related to the operational parameters of the locomotive, especially those relevant to the event precipitating the call home.

In addition to the calls home, on a daily basis, the on-board monitor 10 downloads the stored raw data and statistical information to the remote monitoring and diagnostics center 14. In one embodiment, the daily download duration is approximately five to six minutes. A daily download is deemed successful when the remote monitoring and diagnostics center 14 uploads a "filemaint" file back to the on-board monitor 10.

The on-board monitor also includes a communications mode referred to as call-home pending. This mode is operative when a call home event has occurred, but it was not followed by a successful call home or daily download. That is, a new "filemaint" file was not uploaded because the entire contents of the call-home file were not downloaded to the remote monitoring and diagnostics center 14. It is important that the call home pending status survive through power and reset cycles of the on-board monitor 10, so that the call-home can be successfully completed later.

To initiate a call-home, the processor 22 commands the modem 24 to establish a communications link with the remote monitoring and diagnostics center 14. As discussed above, this link is usually satellite based. As a first step in establishing the communications link, the modem 24 determines the signal strength of the pilot channel of the communications satellite. If this value is above a predetermined threshold limit, the modem 24 is placed into the transmit mode. The on-board monitor 10 then transmits a code identifying the event that precipitated the call home, and other call-home information (including the locomotive road number) as set forth above. For example, one such fault event code notifies the remote monitoring and diagnostics center 14 that the operational log of the on-board monitor 10 is full. Other event codes relate to the occurrence of certain faults or anomalous conditions on board the vehicle. After the call home information is transmitted, the call-home event is logged into a file in the on-board monitor 10, and the call-home terminates.

Upon receipt of the call home information at the remote monitoring and diagnostics center 14, the locomotive road number included within the call home file is used as the index into a table that cross references the locomotive road number with the telephone number (or other alphanumeric access identifier) for the communications system aboard the locomotive. Alternatively, the remote monitoring and diagnostics center 14 determines the uniquely-assigned telephone number (or other alphanumeric access identifier) of the calling communications system and uses these characters as the index into the cross reference table to determine the locomotive road number. To determine the calling telephone number, any of the known caller identification processes can be utilized. Irrespective of the embodiment utilized, at this point the locomotive road number is properly identified and associated with the calling "telephone number" so that information received from an identified calling telephone number can be attributed to correct locomotive.

Using the telephone number or alphanumeric access identifier, the remote monitoring and diagnostics center 14 immediately calls the on-board monitor 10 back. In one embodiment, this call could be placed by simply calling the telephone number over a satellite-based communications link.

Once the communications path is established, the data related to the call home event is downloaded from the on-board monitor 10 to the remote monitoring and diagnostics center 14. As discussed above, this information is analyzed at the remote monitoring and diagnostics center 14 for the purpose of creating a recommendation as to certain repairs that should be performed on the locomotive.

Since the communications system alphanumeric access identifier is uniquely assigned to the modem 24, (or more generally to the communications system of which the modem 24 is an element) when the modem 24 is replaced within a locomotive, the communications system telephone number in the locomotive number/communications system number cross reference table will be incorrect. Therefore, the table will not link the unique locomotive road number with the correct unique communications system access identifier. As a result, the call back from the remote monitoring and diagnostic center 14 to the locomotive will not be placed to the intended locomotive or the call will fail for lack of an answer. If the call is in fact answered, data will be retrieved from the wrong locomotive and will be useless for further analysis at the remote monitoring and diagnostics center 14. Recall that the data received at the remote monitoring and diagnostics center 14 is analyzed based on the unique locomotive road number and recommendations are created based on the unique locomotive road number. If the communications system access identifier and the locomotive road number are not correctly associated with each other at the remote monitoring and diagnostics center 14, then the entire process of analyzing operational data and generating locomotive-specific recommendations breaks down. Further, any routine downloads initiated by the remote monitoring and diagnostics center 14 or downloads performed in response to a railroad customer request will also fail because the correct telephone number to call the locomotive by road number is not available at the remote monitoring and diagnostics center 14. Whenever the telephone number/road/number cross reference table is incorrect, all calls back will not reach the intended locomotive. As will be discussed below, the teachings of the present invention are designed to overcome this occurrence.

When calling home, the on-board monitor 10 calls the first telephone number (or other unique communications access identifier) identified in a start-up configuration file to reach the remote monitoring and diagnostics center 14. The start-up configuration file is transmitted from the monitoring and diagnostics center 14 and stored in the on-board monitor 10. If a successful connection is not established after five minutes or if the call otherwise fails, (e.g., the entire contents of the call-home file have not been transferred), the on-board monitor 10 immediately retries the call using the same telephone number. If this second call is also unsuccessful, the on-board monitor 10 performs two additional calls, using a second telephone number stored in the start-up configuration file.

If the third and fourth calls are also unsuccessful, the on-board monitor 10 enters a call-home pending delay mode, where further call-home attempts are delayed for a period identified in the start-up configuration file. During this delay period, the on-board monitor 10 returns to normal operation and is capable of receiving incoming calls via the modem 24. When the delay period has expired, the on-board monitor 10 retries the calls-home, first using the first telephone number and then using the second telephone number, if required. After a predetermined number of attempts to call-home (where the predetermined number is set forth in the start-up configuration file) the on-board monitor 10 abandons its efforts to call-home and creates an entry in the operational log regarding the unsuccessful efforts to call the remote monitoring and diagnostics center 14.

As a safeguard against protracted calls, the on-board monitor 10 employs call duration limits. If the on-board monitor 10 has been engaged a call for more than a predetermined number of minutes (as set forth in the start-up configuration file) then the call is terminated. If the terminated call was a call-home, then the call-home file will not have been successfully transferred, and the on-board monitor 10 enters the call-home pending state. If instead the terminated call was an incoming call, the on-board monitor 10 continues to answer incoming calls after the termination.

If another call-home event occurs while the on-board monitor 10 is in the call-home pending state, a subsequent call back to the remote monitoring and diagnostics center 14 does not occur until the delay period has expired, but additional call-home faults that occur during this delay time are grouped with the existing call-home event. This process of appending additional events to the call-home file continues until the next call set-up process begins or until an incoming call is detected. All call-home faults -that occur while the on-board monitor 10 is already in the process of setting up a call or during the duration of an incoming call, cause the creation of a new call-home event, which will later result in a separate call to the remote monitoring and diagnostics center 14.

As discussed above, the remote monitoring and diagnostics center 14 initiates periodic calls to each on-board monitor 10 aboard a locomotive for the routine downloading of diagnostic data. If, however, there is a temporary loss of communication, this regular download cannot occur. Also, the installation of a modem 24 or other new communications equipment in the locomotive, generally causes a change to the telephone number used to reach the on-board monitor 10, after which the remote monitoring and diagnostics center 14 will not be able to contact the on-board monitor 10, because, as discussed above, the telephone number/locomotive road number cross reference table will be incorrect.

The call recovery process of the present invention can overcome these communication system failures through the advantageous use of call timers and call logs on the on-board monitor 10. All calls that are received or initiated by the on-board monitor 10 are logged into a call log. According to the present invention, the on-board monitor 10 initiates calls back to the remote monitoring and diagnostics center 14 to resynchronize the communications link based on the contents of the call timers and call logs. The present invention takes into account the geographical location of the on-board monitor 10, (in one embodiment, as determined by a global positioning system receiver) the signal strength for communications from that location, time (based on local call timers or global positioning system information), and the time of the previous successful or unsuccessful call (based on the contents of the call logs) in resynchronizing the communications system.

As discussed above, the remote monitoring and diagnostics center 14 calls each on-board monitor 10 once in every 24-hour period (in one embodiment) to collect vehicle operational data. These calls are identified by reference characters 30 and 32, occurring at 24-hour intervals shown in FIG. 2. The calls 30 and 32 represent successful scheduled downloads.

Figure 2:
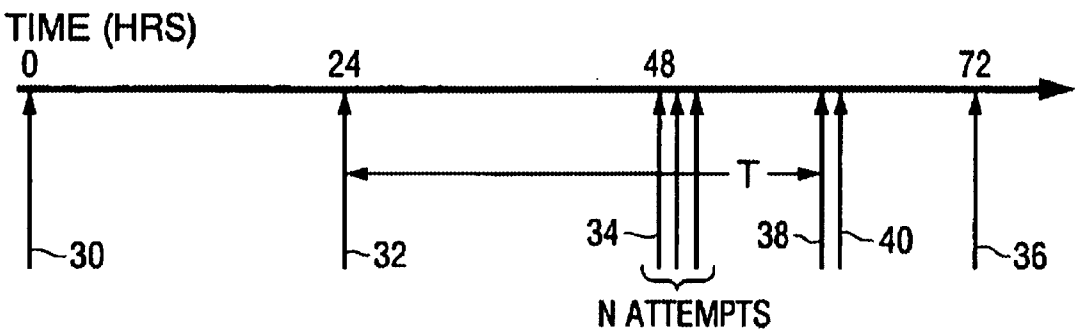
FIG. 2 is a timing diagram illustrating operation of the configuration technique associated with the present invention.

In the event the remote monitoring and diagnostics center 14 is unable to connect to an on-board monitor 10 for a scheduled download or in response to a call-home event, the connection is retried N times. The scheduled download identified by a reference character 34 in FIG. 2 is such an unsuccessful call. In this exemplary embodiment N is equal to three. The actual value is determined at the remote monitoring and diagnostics center based on several factors, including, the cost per call, the communications coverage in the area in where the locomotive is operating, and the locomotive maintenance schedule. After N attempts, the remote monitoring and diagnostics center 14 discontinues further call attempts as discussed below. The N attempts will be deemed unsuccessful when none results in the receipt of "filemaint" file by the on-board monitor 10.

The on-board monitor 10 is equipped with a local call timer. If the on-board monitor does not receive a scheduled download call from the remote monitoring and diagnostics center 14, it will initiate a call thereto, after awaiting a fixed time period (T), as shown in FIG. 2, from the previous successful download. The call from the on-board monitor 10 to the remote monitoring and diagnostics center 14, after the elapse of time T, is identified by a reference character 38 in FIG. 2. The time T may be extended (i.e., extending the wait period before the call is made) if the on-board monitor detects that there is no suitable communications link available from its current geographical location to call the remote monitoring and diagnostics center 14 . In one embodiment, this determination is made based on the signal strength of the pilot channel of the satellite over which the communications link is to be established.

When the period T (or any extensions thereof) has expired and a communications link is available, the on-board monitor 10 initiates the call to the remote monitoring and diagnostics center 14. If the first call is unsuccessful, the on-board monitor 10 continues calling. When the call is successfully connected, the on-board monitor 10 provides the remote monitoring and diagnostics center 14 with certain communications re-synchronization information, including the vehicle road number, the current communications configuration of the on-board monitor 10 (including telephone number) and the current geographical location of the locomotive. Upon receipt, the remote monitoring and diagnostics center 14 determines whether the resynchronization information reflects changes in the communications systems of the on-board monitor 10. If changes are identified, the remote monitoring and diagnostics center 14 updates its records (including the cross-reference table discussed above) for that locomotive. The remote monitoring and diagnostics center 14 then immediately initiates a call to the on-board monitor 10 to download the daily download information that was not previously collected. This subsequent download is identified by reference character 40 in FIG. 2. After this successful download, the system returns to its normal download schedule, with the next scheduled download depicted by the reference character 36.

Figure 3:
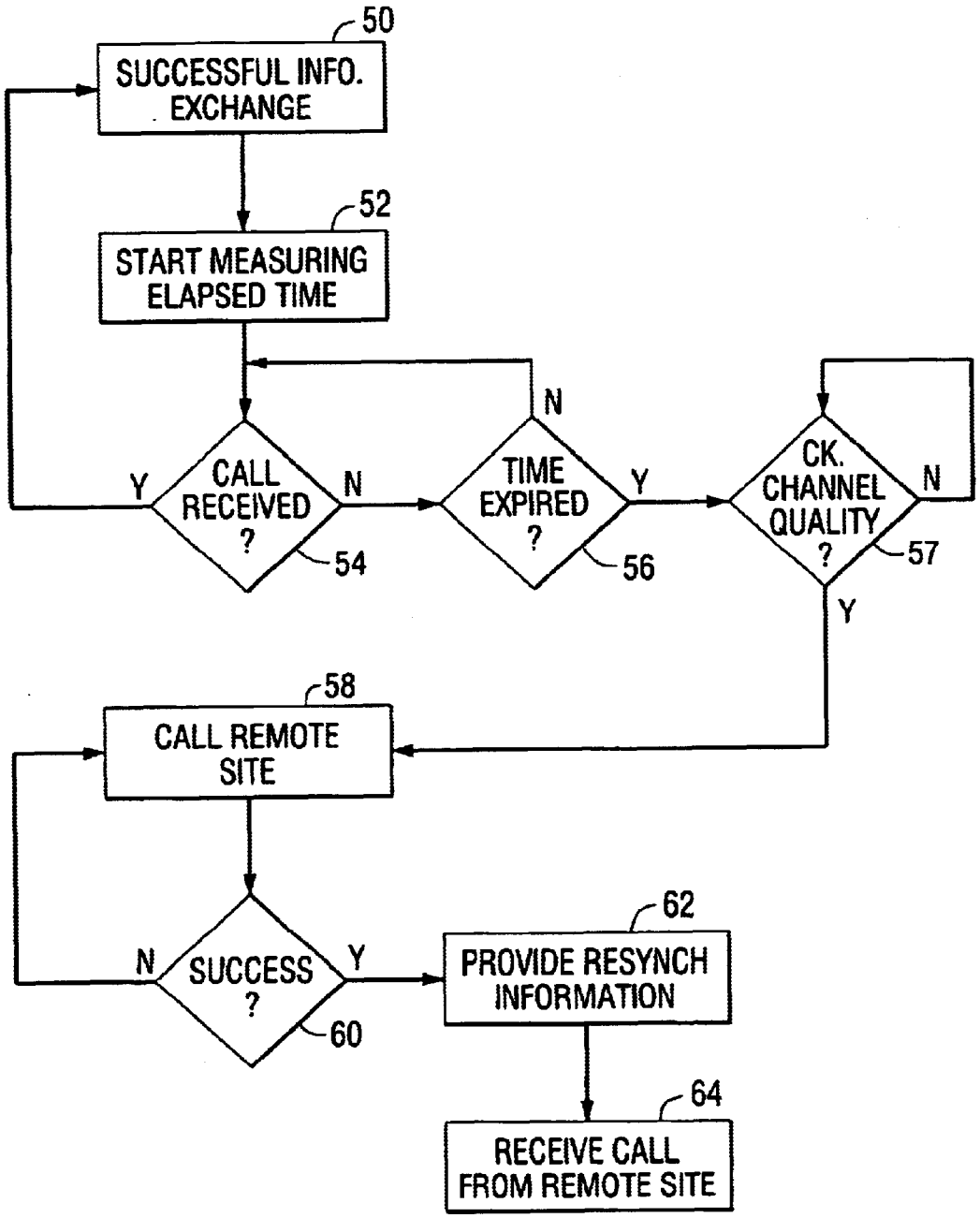
FIG. 3 is a flow chart illustrating the teachings of the present invention.

FIG. 3 is a flow chart illustrating the salient features of the present invention. As discussed above, the remote monitoring and diagnostics center 14 contacts the on-board monitor 10 for periodic downloads and also in response to a call-home received from the on-board monitor 10. A step 50 represents the successful exchange of information between the on-board monitor 10 and the remote monitoring and diagnostics center 14. So long as the remote monitoring and diagnostics center 14 and the on-board monitor 10 continue to exchange information there between. There is no need to execute the call recovery process of FIG. 3. However, at the termination of each successful information exchange, the on-board monitor 10 starts measuring the elapsed time. See a step 52 of FIG. 3. A decision step 54 asks whether a call has been received from the remote monitoring and diagnostics center 14. Whenever a call is received, the output from the decision step 54 is affirmative and processing returns to the step 50 for the exchange of information. As long as no call is received, processing moves from the decision step 54 to a decision step 56 to determine whether the predetermined time has elapsed or, conversely, whether the preset timer has expired. Until the timer expires the process loops back from the decision step 56 to the decision step 54 input. If a call has not been received and the timer has expired, the process moves to a decision step 57 where the communications channel quality is checked by the on-board monitor 10 and its attendant communications devices, in particular the modem 24. Communications between the on-board monitor 10 and the remote monitoring and diagnostics center 14 are not attempted until the link parameters meet certain minimum standards. If the link quality is not acceptable, FIG. 3 illustrates a loop back from the decision step 54 negative output back to the decision step 54 input. It is known by those skilled in the art that a timer can be placed within this loop to control timing of the channel checks. Further, a counter can be placed in this loop so that the channel quality is checked a given number of times before processing exits the loop and returns, for instance, to the step 58. If the link quality exceeds the predetermined threshold, processing moves from the decision step 57 to a step 58 where the on-board monitor 10 contacts the remote monitoring and diagnostics center 14. If the call was successful (see a decision step 60) certain resynchronization information is provided by the on-board monitor 10 to the remote monitoring and diagnostics center 14 at a step 62. In particular, this information includes the locomotive road number or unique vehicle identifier that identifies the locomotive or vehicle on which the on-board monitor 10 resides and the telephone number or other communication access number that will allow the remote monitoring and diagnostics center 14 to successfully contact the on-board monitor 10. Information concerning the current geographical location of the locomotive may also be provided at the step 62. The information received updates the files at the remote monitoring and diagnostics center 14, in particular the cross reference table referred to above. The cross reference table provides a correlation between locomotive road number and communication access number or telephone number. If either of these two perimeters is known, the other can be determined from the tabular values. Now that the cross reference table at the remote monitoring and diagnostics center 14 has been updated, the remote monitoring and diagnostics center 14 contacts the locomotive through the use of the telephone number or communications access number from the table. A step 64 of FIG. 3 illustrates this process where the remote monitoring and diagnostics center 14 contacts the on-board monitor 10. The contact will now result in the successful exchange of information and therefore the process returns to the step 50.

In an effort to avoid busy signals when the on-board monitor 10 calls the remote monitoring and diagnostics center 14, the latter includes a line-hunting capability and sufficient trunk capacity, based on the number of on-board monitors to be serviced by the remote monitoring and diagnostics center 14. This line hunting feature and the additional capacity reduces the probability that the call-back scheme discussed above will interfere with regular daily downloads from remote units.

Returning to FIG. 1, power is supplied to the on-board monitor 10 through both a battery charger and computer circuit breaker 26 and a remote diagnostics circuit breaker 28. When the battery charger and computer circuit breaker 26 is opened, the processor 22 (and thus the on-board monitor 10) executes a shut-down sequence, after which power is still supplied to the modem 24 via the remote diagnostics circuit breaker 28. If the remote diagnostics circuit breaker remains closed, it is therefore possible for the modem 24 to transmit information. To prevent such transmissions, the processor 22 monitors the status of the battery charger and computer circuit breaker 26 and when an open condition is detected, the processor 22 powers down the modem 24. This is necessary to reduce the risk of RF transmissions in the event a maintenance crew is servicing equipment near the antenna 29 connected to the modem 24. If a call is in progress when the open condition of the battery charger and computer circuit breaker 26 is detected, the modem 24 will still be powered down. This feature prevents any transmissions from the modem 24 until the battery charger and computer circuit breaker 26 is again closed.

There are also certain features of the call process associated with calls incoming to the on-board monitor 10. The on-board monitor 10 automatically detects and answers incoming calls, even if it is conducting tests on the health of the modem 24 or preparing to place a call home. If a successful connection is not established within five minutes of answering the incoming call, or if the connection attempt otherwise fails, the on-board monitor 10 adds an entry to its operations log. Once a call is connected, the on-board monitor 10 negotiates the particulars of the data transfer. During a call, the on-board monitor 10 continues to check the health of the modem 24 and checks for unsolicited messages arriving from the modem 24. Additionally, the on-board monitor 10 continues to monitor the status of the battery charger and computer circuit breaker 26. Whenever the on-board monitor 10 has been in a call for a period greater than the "maxcall" minutes (as defined in the start-up configuration file), the on-board monitor 10 automatically terminates that call.

While the invention has been described with reference to a preferred embodiment, it will be understood by those skilled in the art that various changes may be made and equivalent elements may be substituted for elements thereof without departing from the scope of the invention. The scope of the present invention further includes any combination of the elements from the various embodiments set forth herein. In addition, modifications may be made to adapt a particular situation to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. For use with a vehicle comprising a plurality of operational systems controllably monitored by an on-board monitor for collecting operational information therefrom, wherein the on-board monitor communicates with a remote site during which information is transferred therebetween, and wherein the operational information is downloaded to the remote site, a method for establishing communications between the on-board monitor and the remote site, comprising:

determining the elapsed time since the last successful transfer of information between the on-board monitor and the remote site;

calling the remote site if the elapsed time reaches a predetermined value and the on-board monitor has not received a call from the remote site during the elapsed time; and providing predetermined information to the remote site for use by the remote site to call the on-board monitor.

2. The method of claim 1 wherein the predetermined information includes a unique vehicle identifier.

3. The method of claim 1 wherein the predetermined information includes the on-board monitor communications system access number.

4. The method of claim 1 wherein the predetermined information includes the geographical location of the vehicle.

5. The method of claim 1 wherein the vehicle is a railroad locomotive.

6. The method of claim 1 wherein the remote site is a monitoring and diagnostics service center.

7. The method of claim 1 further comprising: receiving a call from the remote site for downloading the operational data, wherein the call is made based on at least a portion of the predetermined information.

8. The method of claim 1 wherein the step of calling the remote site after expiration of the elapsed time is conditional upon the results of a communications link test to the remote site.

9. For use with a vehicle comprising a plurality of operational systems monitored by an on-board monitor for collecting operational information therefrom, wherein a remote site periodically contacts the on-board monitor for downloading operational information therefrom, a method for establishing communications between the on-board monitor and the remote site, comprising:

attempting to contact the on-board monitor a number of times in a given interval from the remote site, wherein none of the contacts results in a successful exchange of information;

at the on-board monitor, determining the elapsed time since a successful exchange of information with the remote site; and calling the remote site when the elapsed time reaches a predetermined value and the on-board monitor has not successfully exchanged information with the remote site.

10. The method of claim 9 wherein the remote site makes a predetermined number of attempts to call the on-board monitor.

11. For use with a vehicle comprising a plurality of operational systems, an on-board monitor for controllably monitoring and collecting operational information, therefrom, wherein said on-board monitor communicates with a remote site during which information is transferred therebetween, and wherein the remote site calls said on-board monitor for downloading the operational information therefrom, said on-board monitor for establishing communications with the remote site, comprising:

a timer for determining the elapsed time since the last successful transfer of operational information with the remote site;

a transmitter for calling the remote site when said timer reaches a predetermined value and a call from the remote site has not been received;

a receiver;

wherein said transmitter provides predetermined information to the remote site for use by the remote site to call said receiver.

12. The on-board monitor of claim 11 wherein the predetermined information includes a vehicle identifier.

13. The on-board monitor of claim 11 wherein the predetermined information includes the on-board monitor communications system access number.

14. The on-board monitor of claim 11 wherein the predetermined information includes the current geographical location of the vehicle.

15. The on-board monitor of claim 11 wherein the vehicle is a railroad locomotive.

16. The on-board monitor of claim 11 wherein the remote site is a monitoring and diagnostic service center.

17. The on-board monitor of claim 11 the receiver receives a call from the remote site using at least a portion of the predetermined information, for the purpose of downloading the operational data.

18. The apparatus of claim 11 wherein the transmitter places the call to the remote site when a predetermined communications link quality exists between the vehicle and the remote site.

19. An article of manufacture comprising:

a computer program product comprising a computer-usable medium having computer-readable code therein for use with a vehicle comprising a plurality of operational systems controllably monitored by an on-board monitor, for collecting operational information therefrom, wherein the on-board monitor communicates with a remote site during which information is transferred therebetween, and wherein the operational information is downloaded to the remote site, for establishing communications between the on-board monitor and the remote site, the computer-readable code in the article of manufacture comprising:

a computer-readable program code module for determining the elapsed time since the last successful transfer of operational information from the on-board monitor to the remote site:

a computer-readable program code module for calling the remote site if the elapsed time reaches a predetermined value and the on-board monitor has not received a call from the remote site during the elapsed time:

a computer-readable program code module for providing predetermined information to the remote site for use by the remote site for calling the on-board monitor.

* * * * *